US006311755B1

(12) United States Patent
Ruggles

(10) Patent No.: US 6,311,755 B1
(45) Date of Patent: Nov. 6, 2001

(54) VERTICAL BLINDS WITH VANES AND FABRIC CONNECTED TO THE VANES AND METHOD OF MANUFACTURING THE SAME

(75) Inventor: Bryan K. Ruggles, Salt Lake City, UT (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 09/252,962

(22) Filed: Feb. 18, 1999

(51) Int. Cl.[7] ..... E06B 9/06
(52) U.S. Cl. ..... 160/84.04
(58) Field of Search ..... 160/84.01, 84.94, 160/84.05, 330, DIG. 7

(56) References Cited

U.S. PATENT DOCUMENTS

| | | | |
|---|---|---|---|
| 3,851,699 | 12/1974 | Shapiro . | |
| 5,297,607 | 3/1994 | Beauchamp . | |
| 5,339,883 | 8/1994 | Colson et al. . | |
| 5,355,298 | * 10/1994 | Robertson | 160/84.04 |
| 5,392,832 | 2/1995 | Colson et al. . | |
| 5,454,414 | 10/1995 | Colson et al. . | |
| 5,490,553 | 2/1996 | Colson et al. . | |
| 5,603,369 | 2/1997 | Colson et al. . | |
| 5,638,881 | 6/1997 | Ruggles et al. . | |
| 5,749,404 | 5/1998 | Colson . | |

FOREIGN PATENT DOCUMENTS

0860577A2 8/1998 (EP) .

OTHER PUBLICATIONS

Ball Screws & Actuators Co. Inc., Linear Bearing Assemblies, Catalog No. LB93–1 (Cover page, p. 3, p. 11).

* cited by examiner

*Primary Examiner*—David M. Purol
(74) *Attorney, Agent, or Firm*—Foley & Lardner

(57) ABSTRACT

A method for manufacturing vertical blinds is disclosed, the method yielding a blind which has curtain material located between the vanes, so that when the blind is deployed across an opening, the vanes may be arranged perpendicularly with respect to the curtain material to allow light into a room or the vanes may be aligned so that they are parallel and overlapping one another, in which case a privacy product results. The method includes preparing discrete pieces of a three component strip having a center portion of curtain material and vane portions bonded to each longitudinal edge of the curtain portion. Adhesive is applied to one or both of the vane portions, and the discrete pieces are placed on an U-shaped mandrel, inverted so that the opening of the "U" faces downwardly. The curtain material portion lies over the rounded top of the mandrel and the vane portion lies against the sides of the mandrel. The mandrel is indexed, another mandrel replaces it and the process is repeated. When the mandrels are indexed, the vanes of adjoining pieces are pressed against one another and are joined by the adhesive. The adhesive employed may be heat activated or be a contact adhesive, and in the most preferred form of the invention, the two vane material portions, when combined with the adhesive, will have substantial rigidity and will be opaque. A novel blind product results from the process.

19 Claims, 4 Drawing Sheets

VERTICAL BLINDS WITH VANES AND FABRIC CONNECTED TO THE VANES AND METHOD OF MANUFACTURING THE SAME

CROSS-REFERENCES TO RELATED APPLICATIONS, IF ANY

None

BACKGROUND OF THE INVENTION

1. Field of the Invention

The present invention relates generally to the art of coverings for windows and doors, and more particularly to the art of vertical blinds which are deployed across a window or door opening and which include vertically disposed vanes which may be closed for privacy or opened to allow a view from the interior and light to enter the room. Still more specifically, the present invention relates to the types of vertical blinds just described which also include curtain material joined to the vanes to give a softer appearance, and, in the case where the blinds are in their open position (with the individual vanes parallel to one another or perpendicular to the window opening), to give some amount of privacy, while still allowing some light to enter the room. In its most preferred form, the present invention relates to a novel method of manufacturing such vertical blinds with curtains.

2. Description of the Prior Art

A wide variety of door and window coverings are known in the art and are available for the consumer when new construction, remodelling or redecorating occurs. Common window coverings include roller shades, mini-blinds, Roman shade products, curtains, cellular and pleated blinds, vertical blinds including vanes only, and in recent years vertical blinds which also include curtain material attached to one or both vertically disposed edges of the vanes to permit light control, a softer and more decorative look, and to provide some amount of privacy, even when the blinds are open. The latter category of door and window coverings has not gained widespread acceptance because of the difficulty and expense of manufacturing such products.

One of the earliest of such blind with curtain products is disclosed in U.S. Pat. No. 5,638,881 issued on Jun. 17, 1997 to Ruggles, et al. and entitled "BLIND WITH CURTAIN". In this device, the individual vanes, constructed of plastic material, are formed with a generally U-shaped socket on one longitudinal edge. Curtain material strips sufficiently wide to join the front portions of adjacent vanes when the vanes are parallel to one another are provided with beads of rigid material on each longitudinal edge. A pair of such curtain strips are placed back-to-back so that the beads of adjacent strips are next to one another and the beads are inserted into the U-shaped sockets to join the curtain material to the plastic vanes. This device provides a very appealing product appearance and suffers only from the time required to manufacture it. This patent also discloses certain techniques for attaching the vanes to a headrail system and is incorporated in its entirety into this disclosure for such purpose. This patent is owned by the assignee of the present invention.

A number of other patents have issued in recent years relating to the same general subject matter of the present application. For example, U.S. Pat. No. 5,339,883 issued on Aug. 23, 1994 to Colson, et al. for "COVERING ASSEMBLY FOR ARCHITECTURAL OPENINGS". In this patent, one of the embodiments includes two parallel sheer fabrics which have spaced apart vanes connected to each sheet. The fabric/vane panels are connected to a track using carriers which allow the vanes to be spread apart or stacked with respect to each other and, when spread apart, to be manipulated between opened and closed positions for light control. The deployment of vanes and the stacking thereof in vertical blinds has, in and of itself, been a known feature for vertical blinds for many, many years.

Another patent issued to Colson, et al. is U.S. Pat. No. 5,392,832 issued Feb. 28, 1995 and entitled "COVERING ASSEMBLY FOR ARCHITECTURAL OPENINGS". This patent also describes the use of a panel with two sheer fabrics attached to a plurality of vanes, the track and particular details of an actuator used with the system. Claims are additionally made concerning the dimensional stability of the sheer fabrics in substantially mutually perpendicular directions, and other claims are directed to the types of materials used to form the panels or sheets of fabric so that the vanes do not twist when they are manipulated.

A further Colson, et al. patent, U.S. Pat. No. 5,490,553, was issued on Feb. 13, 1966 and is entitled "FABRIC WINDOW COVERING WITH RIGIDIFIED VANES". This patent discusses both horizontal and vertical blinds, wherein fabric vanes are impregnated with a stiffening compound so that they can be moved between an open position in which the vanes are perpendicular to the fabric sheets and a closed position in which they are parallel with respect to each other. The patent also discusses the use of loops of material for the vanes and the insertion of rigid slats in the loops to provide the desired amount of stiffness. In such products, hinge lines may also be formed at opposite edges of the vane so that the vanes are flexibly connected to the curtain material.

U.S. Pat. No. 5,603,369 issued to Colson, et al. on Feb. 18, 1997 and is entitled "FABRIC WINDOW COVERING WITH VERTICAL RIGIDIFIED VANES". This patent, which is a division of the aforementioned '553 patent, includes claims to the use of only a single sheet of fabric connected to vanes impregnated with stiffening compounds, as well as the controls for vertically suspending and pivoting the vanes. Additional claims discuss the construction of the vanes from loops of materials with slats inserted therein, providing hinge connections between the fabric sheet and the slats and the control systems mentioned above. Additional claims are provided for two sheets of fabric connected to the vanes, which can be arranged either horizontally or vertically.

A still further Colson patent entitled "FABRIC FOR AN ARCHITECTURAL COVERING AND METHOD AND APPARATUS FOR MANUFACTURING SAME" was issued on May 12, 1998 as U.S. Pat. No. 5,749,404. This patent includes numerous claims relating to the combination of vanes with flaps attached in a variety of different ways to fabric, the connection of the fabric sheet around the flaps, the use of single or double sheets, valances, the use of two sheets and the connection of vanes on either side to different materials at each side edge. The patent indicates in some claimed embodiments that the vanes have a flexibility less than the flexibility of the sheets of fabric material attached thereto.

Despite numerous descriptions of vane and fabric architectural blinds, relatively little information is provided concerning manufacturing techniques. In connection with the Colson patents just mentioned, one manufacturing technique involves the use of an inserter blade between an anvil and a horn to create loops of material to form the vane, with the fabric remaining in an unlooped condition between the loops. Various glue, creaser and folder stations are also involved in the disclosed and illustrated manufacturing embodiment. In most cases, however, no manufacturing information is provided other than that which might be gleaned from an examination of various cross-sectional and perspective views of the blinds with curtains themselves.

The present inventor has found that a significant impediment to the commercialization of such products is the ability to manufacture the products precisely and at low cost, especially with the tendency of various fabric components to wrinkle, crease, stretch, pucker or the like. An efficient technique for manufacturing such door and window coverings would represent a substantial advance in this art. To the extent such manufacturing technique led to the creation of a new blind with curtain product, such advance would be even more significant.

FEATURES AND SUMMARY OF THE INVENTION

The present invention features a novel door or window covering including vanes having fabric attached thereto, the vane material preferably being different from the curtain fabric material.

Another feature of the present invention is a manufacturing method for efficiently preparing such door and window coverings.

A further feature of the present invention is to provide a manufacturing method which may be readily adaptable to a wide variety of starting materials for both the vane and fabric portions and which may be readily adaptable to blinds of different sizes.

Yet a further feature of the present invention is to provide a manufacturing method which has great flexibility with regard to the rigidity of the vane material and the amount of opaqueness thereof.

A further feature of the present invention is to allow low cost materials to be used for a portion of a blind with curtain, while more expensive designer materials may be used for other components.

How these and other features of the present invention are accomplished will be described in the following detailed description of the preferred embodiment, taken in conjunction with the drawings. Generally, however, they are provided by a product and manufacturing method which begins with the creation of a three component elongate strip which may optionally be made in advance and at a different location from the place where the actual blinds with curtain are made. The elongate strip includes a center portion (which will be referred to as the curtain material or curtain portion in this specification) bounded along each lateral edge by vane material or vane portions. The widths of the three portions may be varied depending upon the desired final product specifications. Typically, the curtain material will be fashion oriented and may be more expensive than the vane material. The vane material is typically opaque and may be rigidified either by its own structure or the addition of various stiffening compounds. The curtain and vane materials are attached to each other to form the three component strip by adhesives, ultrasonic welding or other combining techniques. To prepare the blind with curtain according to the present invention, discrete pieces of the three component strip are cut to a desired length, following which the cut pieces are fed sequentially through a conveyor system to the top of inverted, generally U-shaped mandrels arranged so that the curtain material rests along the top of the mandrel with the vane material draped along either side thereof. Prior to the mandrel placement step, adhesive is applied to the vane material. Following the mandrel placement step, one mandrel is indexed laterally and another mandrel is located to receive another piece of the three component strip. That mandrel is then indexed, causing two vane portions to come into contact with one another. At this point, and depending on the type of adhesive used, bonding occurs between the two adjacent vane portions to form a double layer vane. The process is repeated as many times as desired to provide a blind with curtain of a desired width. If the adhesive is a heat set adhesive, the mandrels may be heated in ways which will be described below. If liquid adhesives are applied before the mandrel placement step, the adhesives may simply bond the vane portions to one another, or contact adhesives could be employed which are activated merely by pressure exerted by the mandrels once they have indexed away from the placement location.

Other ways in which the features of the present invention are accomplished will become apparent to those skilled in the art after they have read this specification. Such other ways are deemed to fall within the scope of the present invention if they fall within the scope of the claims which follow.

DESCRIPTION OF THE DRAWINGS

In the following drawings, like reference numerals are used to indicate like components.

DETAILED DESCRIPTION OF THE PREFERRED EMBODIMENT

Figure 1:
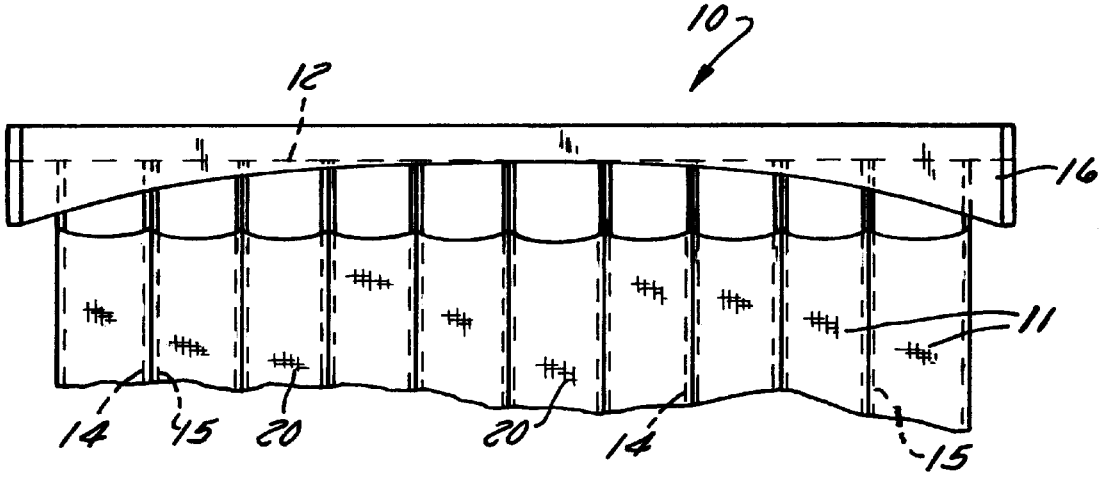
FIG. 1 is front elevation view of a vertical blind with curtain system, having vertical vanes in a closed position.

Before proceeding to the detailed description of the preferred embodiment, several general comments should be made about the applicability and the scope of the present invention.

First, with regard to the types of materials which may be employed for preparing the blind with curtain, one starting material will be referred to in this specification as "curtain material". This will be the material located between the vanes and which will be prominent when the blind is deployed across the door or window opening with which it is used. The curtain material will be softly folded when the vanes are retracted to their closed position as is generally known in the vertical blind art. When the vanes are in their deployed position, the curtain material is located across the expanse of the door or window whether or not the vanes are rotated between their parallel position (in which they generally lie parallel to the curtain material and behind the same when viewed from the inside) or their open position (in which they are generally perpendicular to the curtain material).

The other major starting material will be the "vane material", typically a lesser cost and more opaque material. Fabrics are preferred for both the curtain and the vane material, but the fabrics may be selected from a wide variety of woven and non-woven materials. If sonic welding will be used to join the two portions of vane material to the center portion of curtain material, one or both of the materials must be thermoplastic to allow a heat seal to form. Other techniques, however, may be used for joining the curtain and vane materials, such as sewing or the use of various types of adhesives. In addition the vane material may be, and preferably should be, stiffer than the curtain material. The stiffening may be accomplished by using stiff material to begin with or by adding stiffening compounds.

The adhesives used in the invention may be liquid adhesives which remain liquid until portions of the two materials to be joined are placed against one another and may cure through heat, catalytic curing, drying or the like. The adhesives also may generally be applied to either or both surfaces to be joined. If adhesives are used for the preparation of the starting three component strip, the adhesive may be applied to either the curtain or the vane material. Similarly, in the manufacturing operation, the adhesive may be applied to one or both of the vane portions which will be joined together.

Further, various dimensional relationships and numbers of components will be referred to in the following description, but they are to be taken as illustrative rather than limiting in any respect. For example, the overall length of the mandrels and the number thereof may be widely varied by those skilled in the art after they understand the principles of the present invention.

Next, the hardware components used with blinds with curtains manufactured according to the present invention will not be described in detail, because in and of themselves they form no part of the present invention. For example, most vertical blinds include an elongate track above the opening to be covered. Trucks are mounted for movement along the track, either by the use of a wand or by the use of cords and pulleys. From these trucks, components descend and engage the upper end of the vanes. Structure within the top rail, operated either by the wand or by additional cords cause rotation of such components which in turn causes the vanes to move between their parallel and perpendicular positions. Various other features known to the vertical blind art may also be incorporated for use with products made according to this invention, such as the use of a single wand for deploying the blind across the opening and for the rotation of the vanes. Furthermore, various known tracking equipment can be included in the head rail to prevent the bunching of vanes at the outer end of the blind when retraction is initiated.

Finally, in the illustrated and preferred embodiment, heat is used to assist in the bonding of vane material to vane material between mandrels, and the heat may be supplied in a variety of ways. Heated air may be forced through hollow mandrels, or induction heating may be employed. In addition, an entire set of mandrels, in their closed position, may be placed into a warmed environment to create the desired adhesive bond.

Figure 2:
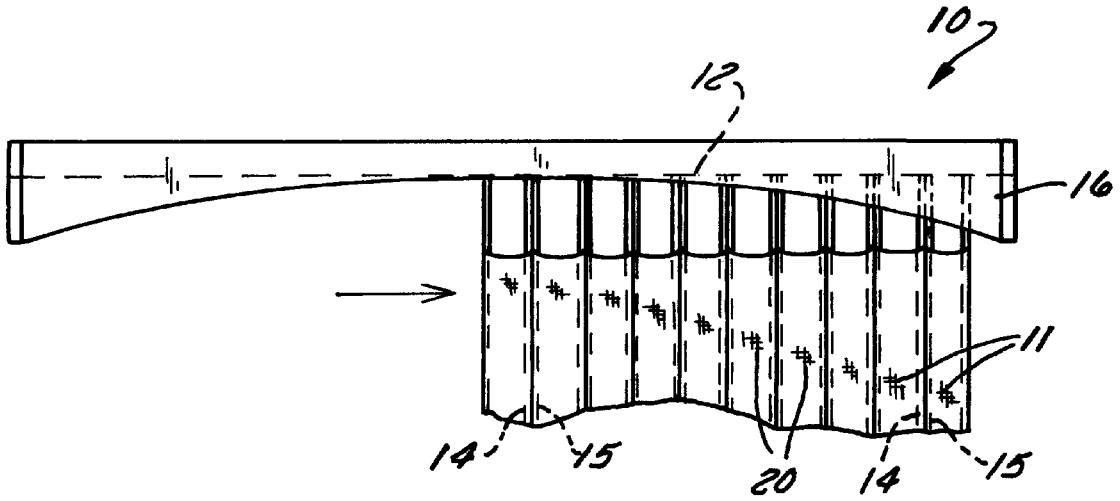
FIG. 2 is a front elevation view, similar to that of FIG. 1, but showing the vanes in an open position.

Proceeding now to a description of the present invention, FIG. 1 illustrates a typical blind assembly 10 including a plurality of free-hanging elongated vertical vanes 11. Each of the vanes 11 is supported at its upper end 12 so as to hang in a substantially vertical position. The vanes will hang in a preselected, spaced apart relation to one another in a manner which enables each of the vanes to rotate about its longitudinal axis between an open position as shown in FIG. 2 and a closed position shown in FIG. 1. Each vane 11 has a bottom end (not shown) and a top end 12, as well as a front or leading longitudinal edge area 14 and a back, longitudinal edge 15. The vanes are laterally sized so that the front edge 14 of each vane overlaps the back edge 15 of the next adjacent vane, when the vanes are in the closed vane position as is shown in FIG. 1.

FIG. 1 also includes a decorative valance 16, behind which the track and other operating components discussed previously are deployed. When in the FIG. 2 position, a wand or cords can be used to urge the left most vane 11 toward the right, thereby causing the vanes to approach one another. FIG. 1 and FIG. 2 also illustrate the curtain material 20 which is provided between each of the vanes 11. Again, it should be pointed out that FIGS. 1 and 2 serve only for purposes of illustrating well known background for a better understanding of the advancements made in connection with the present invention.

Figure 3:
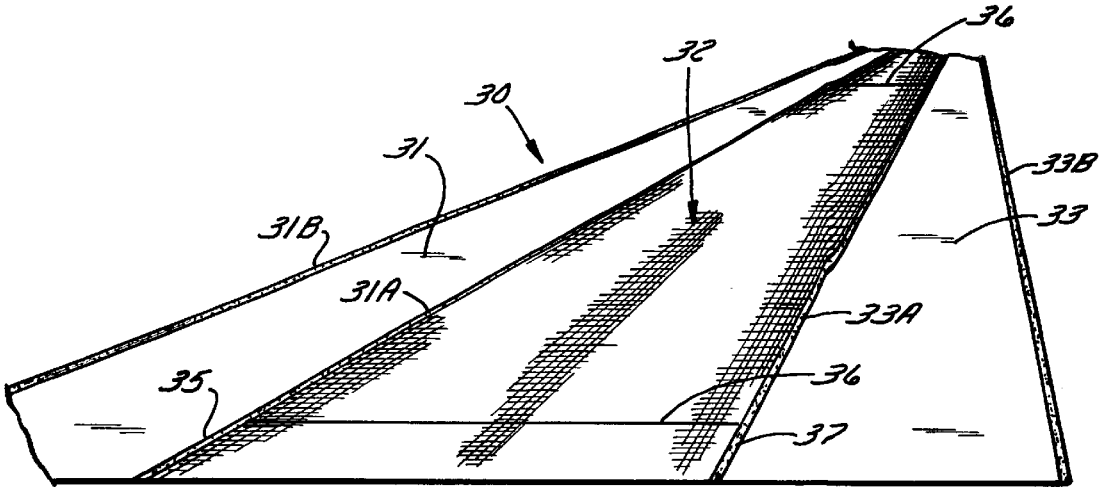
FIG. 3 is a perspective view of the three component fabric strip according to a preferred form of the present invention.

Unlike the bead and socket curtain attachment technique described in the aforementioned Ruggles, et al. '881 patent, or the vane and fabric sheet attachment systems described in the Colson or Colson, et al. patents described above, the present invention employs an elongate strip 30 of material to form one half of a first vane, the curtain material extending between a pair of vanes and one-half of an adjacent vane. FIG. 3 illustrates, in a schematic way, such elongate strip material 30. It is comprised of three longitudinally extending portions 31–33. Portions 31 and 33 are vane material, and for purposes of the description of the preferred embodiment, are opaque, non-woven and relatively inexpensive polyester material. On the other hand, portion 32 is illustrated as being a woven fabric which may be relatively more expensive. This is usually acceptable since it will be visible to the user of the blind. FIG. 3 also shows a pair of seal lines 35 and 37 extending the length of strip 30. For purposes of this illustration, each of seal lines 35 and 37 can be considered to be adhesive seal lines. These seals can be created at high speeds, allowing the strip 30 to be made "on-line".

Before proceeding to a description of the preferred manufacturing machinery, the process will be briefly explained. The manufacturing operation includes the preparation of strip 30, cutting thereof into distinct pieces, the transport of the cut pieces along a conveyor path during which the vane material portions 31 and 33 are dropped downwardly. Adhesive is applied to one or both of the outer facing surfaces of the vane material 31 and 33 prior to this conveying step. Each of the pieces are then fed, one at a time, onto inverted U-shaped mandrels, so that the curtain material 32 lies on the upper curved portion of a mandrel, while the vane material 31 and 33 lies against the flat sides thereof. Through a timing and weight mechanism, mandrels are indexed after a cut piece is placed thereover, and the vane material 31 of one cut piece is clamped against the vane material 33 of the following piece. When a sufficient number of vanes have been thus formed, and any required heating or other treatment has been carried out to cure the adhesive, the mandrels are opened slightly for the removal of the finished fabric components of the vertical blind with curtain.

Figure 4:
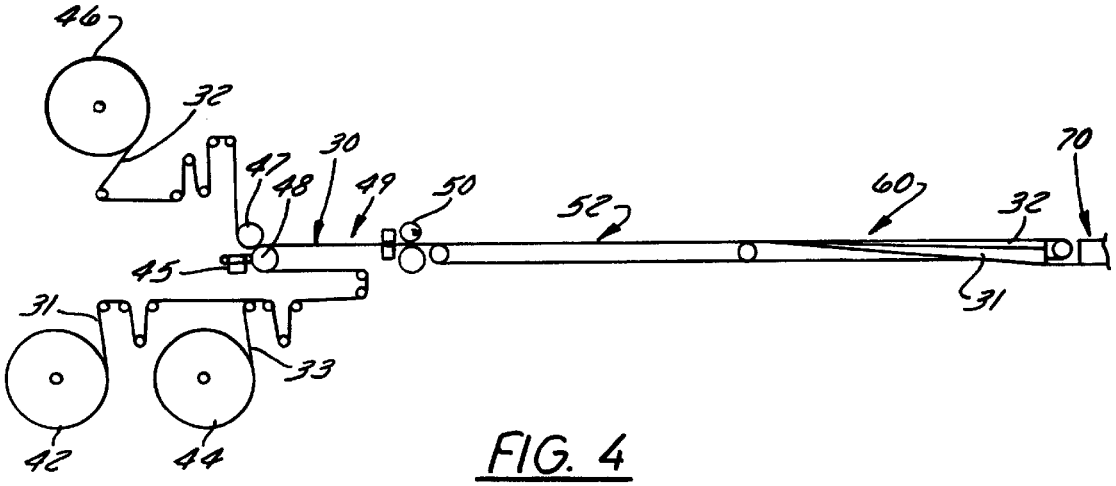
FIG. 4 is a side diagrammatic view showing a manufacturing process for preparing the strip of FIG. 3 and cutting same into pieces of a desired length.

With reference to FIG. 4, a device for preparing a blind with curtain according to the preferred embodiment of the invention is shown in schematic form. The three component strip 30 is first prepared starting with rolls 42 and 44 of vane material 31 and 33 respectively and roll 46 of curtain material 32. In the illustrated process, adhesive is placed on the materials in four locations. A first bead is placed on the inner edge 31A and 33B of portions 31 and 33 just prior to overlapping them with the curtain material portion 32, at which point bonding occurs under the nip rollers 46 and 47. An adhesive application station is generally illustrated at 45. Adhesive is also applied to the upwardly facing surfaces of vane material portions 31 and 33, along the outer edges 31B and 33B thereof. Adhesive may also be applied to areas between the outer and inner edges of the vane material portions, such as by bead application, spraying, brushing, the use of a doctor blade or the like. The combination strip 30 proceeds along the process area 49 until it approaches a rotary cut-off knife 50 which may be of the same design as the knife used in the preparation of cellular blinds known to the art. Combination strip 30 may include a signalling hem strip area periodically along its length (see reference number 36 in FIG. 3) if photocells are used to activate the knife 50.

Discrete pieces of the three component strip 30, after passing through knife 50 then enter a two stage conveyor. The first section 52 is an acceleration section comprised of a circular, rounded O-ring type central belt 55 (seen best in FIG. 5), flanked on either side by flat belts 57 and 58. Belts 55, 57 and 58 travel at an equivalent speed to each other, but at a speed which is faster than the speed upstream of the cut-off knife 50, so that the discrete pieces of strip 30 travel to the right (with reference to FIG. 4).

The second section of the conveyor system is designated generally as 60. In this section, belts 57 and 58 gradually drop away from supporting the vane portions 31 and 33, so that they droop to a vertical, unsupported position with respect to the curtain material portion 32. At the end of section 60, the curtain material 32 still travels on the rounded belt 55. A vertical cross-section of a piece of strip 30 at this point in the process would look like an inverted U. The curtain material 32 forms the top of the inverted U and the vane material 31 and 33 forms the sides.

Figure 5:
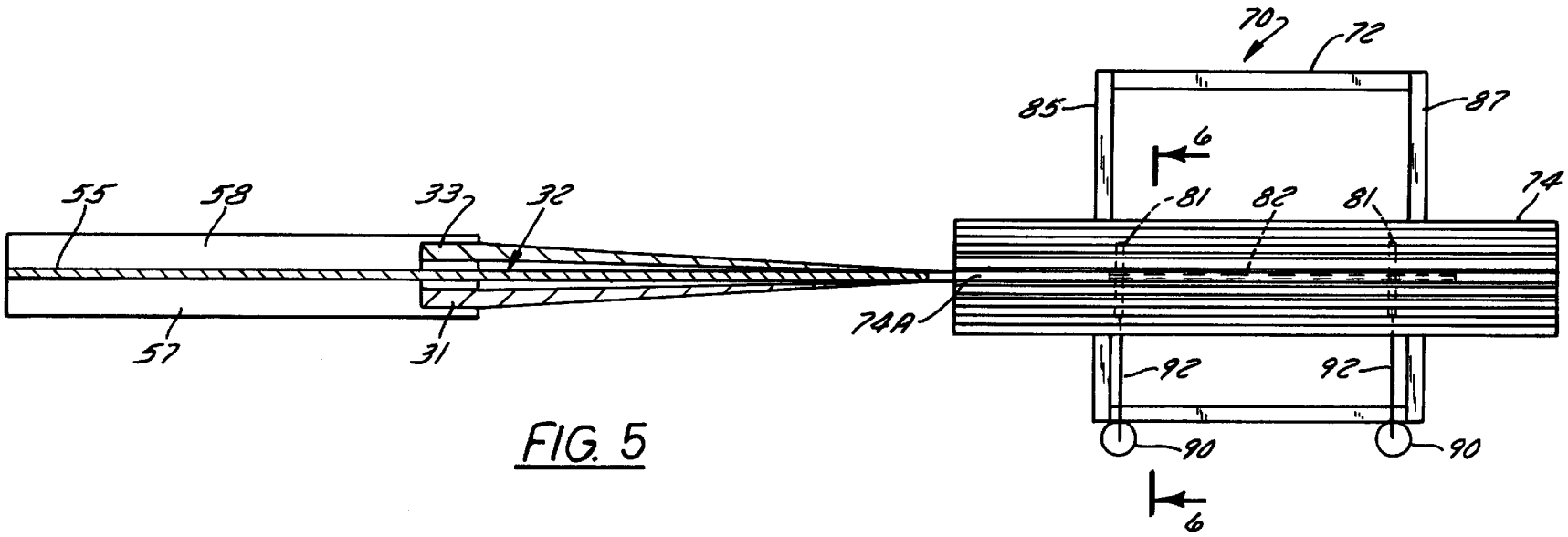
FIG. 5 is a top view of further components of the manufacturing device of the present invention, showing the folding of the pieces of the three component strip and the application of the pieces of the strip to mandrels.
Figure 6:
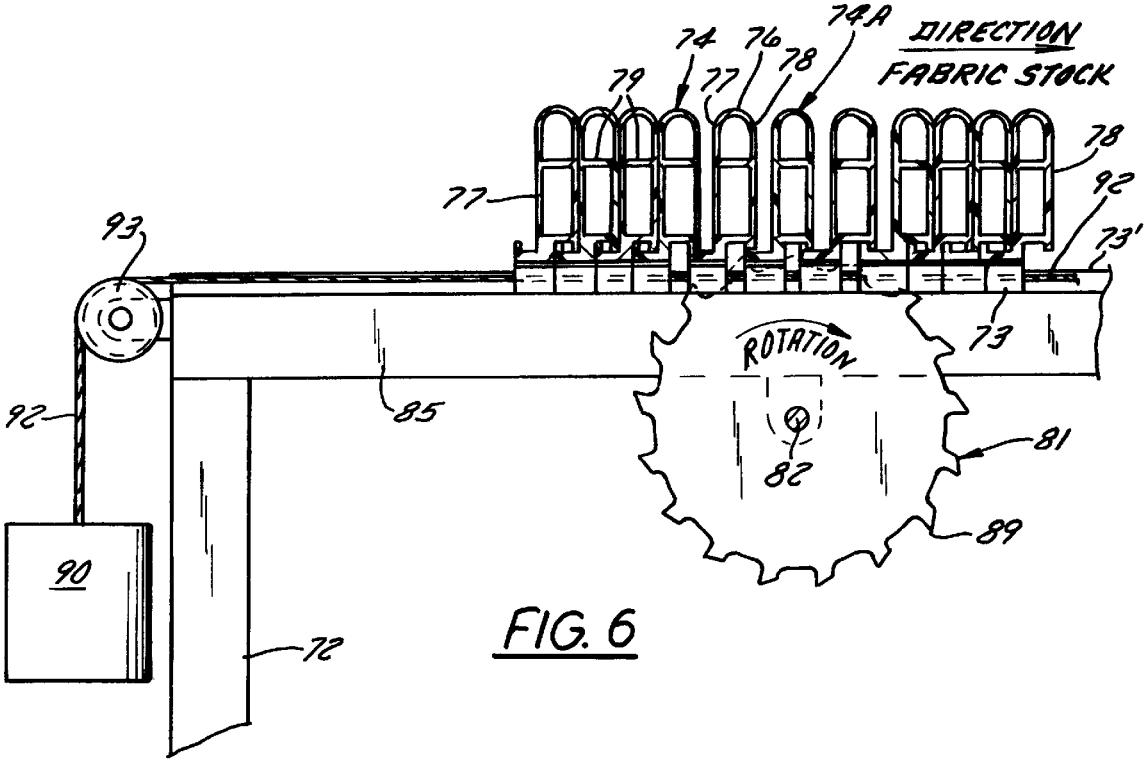
FIG. 6 is an end view of the mandrel station shown in FIG. 5 taken along the line 6—6 thereof.

The next step in the process is shown best in FIGS. 5 and 6 where the assembly of a plurality of discrete pieces of strip 30 is illustrated. At the end of conveyor section 60 an indexing mandrel section 70 is located to receive the discrete pieces of strip 30. A frame 72 supports a plurality of inverted U-shaped mandrels 74, each of which may be selectively placed at the discharge end of conveyor section 60. Each mandrel 74 is at lest as long as the length of the blind with curtain to be made and the number of mandrels 74 is selected based on the width of the blind with curtain, i.e. the number of vanes which are required for a vertical blind to cover a particular opening. Each mandrel 74 has a curved upper portion 76 and two parallel and spaced apart sides, 77 and 78, ideally configured to fully contact the underside of the cut pieces of strip 30 so that the curtain material 32 fully covers the upper portions 76 of mandrels 74 and the sides are least as long as the width of the vane material portions 31 and 33. A web 79 extends between the sides 77 and 78 of the mandrel for internal support. The mandrels may be constructed from a variety of plastic or metal materials, heat conductive metals being preferred if heat is used in the final vane to vane bonding step. The mandrels 74 are individually supported periodically down their length by ball bearing linear slides 73. These slides movably rest on a precision ground track 73' which facilitates virtually frictionless travel perpendicular to the length of the mandrels. Such slide and tracks are in and of themselves well known as indicated in the catalog LB93-1 supplied with this specification from Ball Screws & Actuators Co., Inc.

Placement of the cut pieces of strip 30 onto mandrels 74 may be carried out by the apparatus illustrated, where the mandrels 74 are horizontally arranged, or it may be carried out using downwardly inclined mandrels which are lower at the ends thereof remote from section 60 of the conveyor. Transfer to the mandrels 74 can also be enhanced by providing a smooth outer surface on the mandrels or be providing sufficient frictional contact between the belt 55 and the curtain material lying thereover so that the conveyor section 60 in effect "pushes" the strip 30 onto the mandrels 74. Use of an elastomer belt, such as a urethane belt, is especially preferred.

Indexing of the mandrels is accomplished in the illustrated embodiment by a pair of indexing wheels 81 located on frame 72 below mandrels 74. The indexing wheels are located on a common shaft 82, driven by a motor (not shown) at timing intervals determined for the specific process.

A first one of the indexing wheels 81 is located within frame 72 and generally adjacent but inwardly of the front upper beam thereof, designated as reference number 85. The second indexing wheel is located just inwardly of the rear upper support beam 87. As illustrated best in FIG. 5, the mandrels extend outwardly of the frame 72, the amount not being critical and depending primarily on the overall length of the blinds with curtain to be made at a particular facility.

FIG. 6 illustrates best the spacing of the mandrels which is caused by teeth 89 on the indexing wheel which engage the lower portions of the mandrels 74. The central mandrel, designated as 74A in FIG. 6 will be located immediately downstream of the belt 55 from conveyor section 60, while the unfilled and filled mandrels extend on either side thereof, the direction not being critical. In the drawings the fabric stack is being created on the right side of FIG. 6.

FIGS. 5 and 6 also show a weight system including a pair of weights 90 having a line 92 extending therefrom and passing over a pulley 93 (see FIG. 6). The line 92 has a first end connected to weight 90 and a second end connected to the most remote mandrel 74. It should be apparent then, from this disclosure, that the weights will force the mandrels toward one another to assist in the pressing of the respective sections of vane materials 31 and 33 together. Other force applying systems, such as hydraulic or pneumatic systems can be substituted for the weight system shown in the drawings.

Once all the mandrels have indexed and a piece of composite strip 30 has been applied to each, the adhesive can be cured through drying, the forcing of heated air through the elongate mandrels 74, or the entire frame 72 and its accompanying structure can be moved into an area where the temperature is sufficiently high to cause cure or reaction of the adhesive. If rollers (not shown) are placed on the lower end of frame 72, the transport of the frames is easily facilitated.

Figure 7:
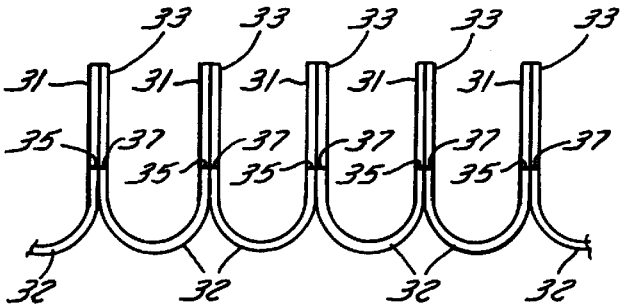
FIG. 7 is a horizontal cross-section of a blind with curtain made according to the preferred method described in this specification.

In connection with the adhesives, it will be clear at this point that if only a single bead of adhesive is applied to the outer edges 31B and 33B of the vane material, together with the application of the adhesive at the inner edges 31A and 33A thereof, the vane which will result for the final product made by the method of the present invention will be hollow, i.e. attached at the longitudinal edges thereof, but that if adhesive is applied across the entire faces of portions 31 and 33, a unitary vane comprised of two overlapping layers of material will be formed. A cross-section taken horizontally through a blind with curtain 10 made according to the present invention is illustrated in FIG. 7, which FIGURE represents the latter of the previous two examples, i.e. where there is uniform adhesive application across the surfaces of the vane portions 31 and 33. Cutting the length to the size required for a particular application, and the attachment of the vanes to deployment hardware will complete the preparation of a blind with curtain 10 made according to the present invention.

While the instant invention has been described in connection with a particular preferred embodiment and several references have been made to alternatives which may be used, the invention is not to be limited by the above description, but is to be limited solely by the scope of the claims which follow.

What is claimed is:

1. A blind with curtain product comprising a plurality of elongate separate vanes, each vane comprising a first layer of vane material attached to a second layer of vane material and each vane layer having separate first and second longitudinal edges; and a separate curtain material between each pair of the plurality of vanes, the curtain material having first and second longitudinal edges, the first longitudinal edge of the curtain material being attached to the first layer of vane material of one of such vane pairs and the second longitudinal edge of the curtain material being attached to the second layer of vane material of the other of such vane pairs;

wherein the curtain material is different that the first layer of vane material and second layer of vane material.

2. The blind with curtain of claim 1 wherein the curtain attachment to the vane material is an adhesive attachment.

3. The blind with curtain of claim 1 wherein the curtain attachment to the vane material is a sonic weld.

4. The blind with curtain of claim 1 wherein the first and second layers of vane material are attached to each other adjacent the longitudinal edges thereof.

5. The blind with curtain of claim 1 wherein the first and second layers of vane material are attached to each other across substantially all of their confronting surfaces.

6. The blind with curtain of claim 1, further providing that the curtain material between each vane pair being formed from a continuous roll of curtain material, the top region of each curtain material and a bottom region of an adjacent curtain material being formed from contiguous sections of the roll of curtain material.

7. The blind with curtain of claim 1, wherein each vane includes a rear edge distal the curtain material formed from a rear edge of the first vane layer and a separate rear edge of the second vane layer.

8. A blind with curtain product comprising:

a plurality of separate strips, each strip including three longitudinally extending separate portions including a first portion, a separate second portion, and a third portion attached to and extending between the first and second portions;

the first portion of each strip being secured to the second portion of an adjacent separate strip forming a single vane; and the third portion being formed from a different material than the first and second portions, wherein the third portions form a curtain wherein each strip includes a first outer longitudinal edge and a second separate outer longitudinal edge, the first outer longitudinal edge of each strip being proximate the second outer longitudinal edge of an adjacent strip.

9. The blind with curtain of claim 8, wherein the third portion is attached to the first and second portions with an adhesive.

10. The blind with curtain of claim 8, wherein the third portion is sonically welded to the first and second portions.

11. The blind with curtain of claim 8, wherein each first and second portions include an inner longitudinal edge, the third portion being attached to the first and second portions proximate the inner longitudinal edges of the first and second portions, the first portion of one strip being attached to the second portion of an adjacent strip along the respective inner longitudinal edges and outer longitudinal edges of the portions forming a pocket there between.

12. The blind with curtain of claim 8, wherein each first and second portions include an inner face and an outer face, the first portion of one strip being attached to the second portion of an adjacent strip across substantially all of their outer faces.

13. The blind with curtain of claim 8, further providing that the curtain portion of each strip being formed from a continuous roll of curtain material, such that a top region of each curtain portion and a bottom region of an adjacent curtain portion are formed from contiguous sections of the roll of curtain material.

14. A blind with curtain product comprising:

a plurality of adjacent separate strips, each separate strip having three longitudinally extending separate portions including a first portion of vane material, a separate second portion of vane material, and a third portion of curtain material extending between the first and second portions of vane material;

the third portion of curtain material being formed from a different material than the first and second portions of vane material;

each portion of vane material having an inner longitudinal edge proximate to a respective longitudinal edge of the third portion of curtain material, and a separate outer longitudinal edge distal the curtain material;

the outer longitudinal edge of the first portion of vane material being proximate the outer longitudinal edge of the second portion of vane material of another strip; and the first portion of vane material of each strip being attached to the second portion of vane material of an another strip to form a respective window vane.

15. The blind with curtain of claim 14, wherein the third portion of curtain material is attached to the first and second portions of vane material with an adhesive.

16. The blind with curtain of claim 14, wherein the third portion of curtain material is sonically welded to the first and second portions of vane material.

17. The blind with curtain of claim 14, herein each first and second portions of vane material include an inner longitudinal edge, the third portion of curtain material being attached to the first and second portions of vane material proximate the inner longitudinal edges of the first and second portions of vane material, the first portion of vane material of one strip being attached to the second portion of vane material of an adjacent strip along the respective inner longitudinal edges and outer longitudinal edges of the vane portions forming a pocket there between.

18. The blind with curtain of claim 14, wherein each first and second portions of vane material include an inner face and an outer face, the first portion of vane material of one strip being attached to the second portion of vane material of an adjacent strip across substantially all of their outer faces.

19. The blind with curtain of claim 14, further providing that the third portion of curtain material of each strip being formed from a continuous roll of curtain material, such that a top region of each third portion of curtain material and a bottom region of an adjacent third portion of curtain material are formed from contiguous sections of the roll of curtain material.

* * * * *